US005533285A

United States Patent [19]

Skistimas et al.

[11] Patent Number: 5,533,285

[45] Date of Patent: Jul. 9, 1996

[54] METHOD AND APPARATUS FOR BALLOON DISPLAYS

[75] Inventors: James A. Skistimas, Highland Village, Tex.; Christian M. Hoebener, Wichita, Kans.

[73] Assignee: Continental American Corporation, Wichita, Kans.

[21] Appl. No.: 289,669

[22] Filed: Aug. 12, 1994

Related U.S. Application Data

[63] Continuation-in-part of Ser. No. 190,444, Feb. 1, 1994.

[51] Int. Cl.[6] ..... G09F 7/00

[52] U.S. Cl. ..... 40/584; 40/212; 211/89; 434/81

[58] Field of Search ..... 446/221; 273/380, 273/458; 403/394, 397, 388, 400; 434/81, 98; 211/14, 89, 182; 40/212, 214, 217, 584, 541, 421

[56] References Cited

U.S. PATENT DOCUMENTS

| | | | |
|---|---|---|---|
| 935,905 | 10/1909 | Gilliland | 403/394 |
| 1,642,022 | 9/1927 | Groh | 40/212 |
| 1,658,275 | 2/1928 | Wright | 40/214 |
| 1,781,458 | 11/1930 | Gore | 403/388 |
| 1,813,901 | 7/1931 | Bayne | 434/81 X |
| 2,247,635 | 7/1941 | Illers | 273/380 |
| 3,046,040 | 7/1962 | Luper | 403/388 |
| 3,358,298 | 12/1967 | Chalfin . | |
| 3,448,538 | 6/1969 | Maze | 40/541 |
| 3,685,825 | 8/1972 | Dorazio | 273/458 |
| 4,155,552 | 5/1979 | Jacobo et al. | 273/380 X |
| 4,226,902 | 10/1980 | Webb . | |
| 4,261,470 | 4/1981 | Dolan | 211/182 X |
| 4,545,490 | 10/1985 | Hsiao et al. | 211/182 X |
| 4,850,926 | 7/1989 | Lovik | 446/222 |
| 4,927,400 | 5/1990 | Lovik | 446/220 |
| 4,941,856 | 7/1990 | Lovik | 446/220 |
| 5,141,463 | 8/1992 | Rouse, Jr. | 446/221 |
| 5,199,200 | 4/1993 | Howell | 40/152 |
| 5,333,950 | 8/1994 | Zachrai | 211/182 X |

OTHER PUBLICATIONS

Letter from Graham Rouse and Mary Queen dated Dec. 20, 1994.
Aug., 1987 "Balloons Today" article regarding Spooney Morril.
Feb., 1988 "Balloons Today" article; p. 57.
Rouse Balloon Art Designer Panels description.
Oct., 1988 article of "Balloons Today" showing Palm Leaf Rouse Balloon Art Designer Panels.
Pages 22 & 23 of Gary Wells' book "Design".
Pages 16–18 of Mar./Apr., 1992 issue of "Images".
Cover page & p. 4 of Jan./Feb., 1993 issue of "Images".
Cover page & p. 36 of Jan., 1993 issue of "Balloon World".
Page 20 of a Special Events flyer; page from Jul./Aug., 1993 edition of "Images".
Pages 8 & 9 of Sep./Oct., 1992 issue "Images".
Page 32 of Mar./Apr., 1993 issue of "Images".
Page 12 of May/Jun., 1993 issue of "Images".
Page 4 of Jan./Feb., 1994 issue of "Images".
Page 15 of May/Jun./Jul., 1994 issue of "Images".

*Primary Examiner*—Joanne Silbermann
*Attorney, Agent, or Firm*—Stinson, Mag & Fizzell

[57] ABSTRACT

A three-dimensional balloon display comprising a grid array comprised of at least one set of grid members, each set of grid members having a front side and a back side. The grid members are each shaped to form a compartment for receipt of at least one inflated balloon. The compartments have an interior side and an exterior side. An inflated balloon is maintained in the compartment by the pneumatic pressure within the inflated balloon exerted against the interior side of the compartment to create the three-dimensional display. In an alternative embodiment, a second set of grid members is aligned with the first set of grid members to create a three-dimensional compartment for receipt of the inflated balloon.

18 Claims, 7 Drawing Sheets

Fig. 6
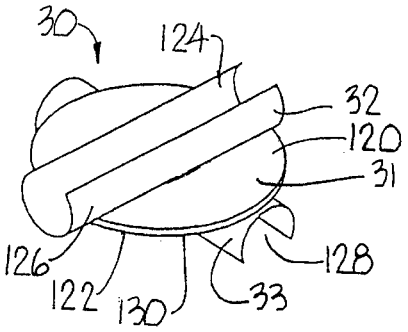
Fig. 6a.
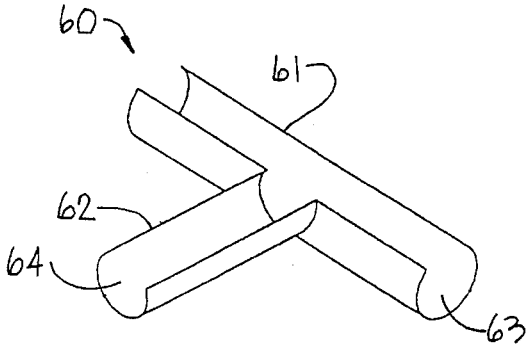
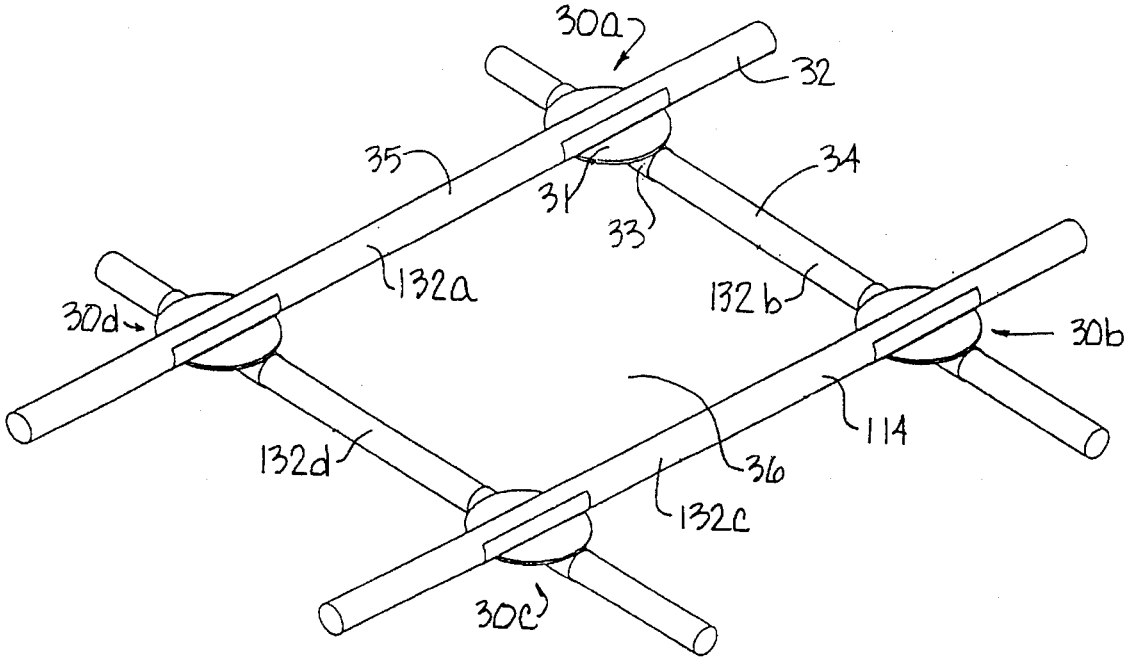
Fig. 7

METHOD AND APPARATUS FOR BALLOON DISPLAYS

RELATED APPLICATION

This is a continuation-in-part of application Ser. No. 08/190,444 filed Feb. 1, 1994.

FIELD OF THE INVENTION

This invention relates to decorative designs utilizing balloons, and more particularly to an apparatus which utilizes a grid and balloons for artistic, three-dimensional displays.

BACKGROUND OF THE INVENTION

The current practice of using balloons for decorative purposes normally requires a plurality of balloons tied together, forming animated objects and other decorative motifs. For example, in U.S. Pat. Nos. 4,850,926, 4,927,400 and 4,941,856, rigid, rod-like forms are used to stretch inflated balloons to deform them and connect several balloons together for multiple balloon displays. Each balloon in the display is inflated. U.S. Pat. No. 5,141,463 utilizes a rigid rod in the balloon or membrane and the membrane is then inflated. U.S. Pat. No. 4,226,902 utilizes a flat back on which a gas-tight envelope is mounted and inflated.

Other prior art methods include inserting balloons within balloons and inflating the inner as well as the outer balloon. In each case cited above, the outer envelope of the decorative object must be airtight to allow inflation of the outer envelope.

SUMMARY OF THE INVENTION

The present invention is to an apparatus for making three-dimensional balloon displays. The apparatus is comprised of a grid array. The grid array has at least one set of grid members, with each grid member shaped to form a compartment for receipt of at least one inflated balloon. Each compartment has an interior and exterior side. The balloons are maintained within the compartment by the pneumatic pressure within the inflated balloon exerted against the interior side of the compartment. The compartments may be of any geometrical shape. Additionally, one or more balloons may be inserted in each compartment, each balloon being of the same or different color to form a distinct design.

In an alternate embodiment, the apparatus is further comprised of a second set of grid members with each grid member shaped to form a compartment and a rigid frame attached to both sets of grid members. In this alternative embodiment, the first and second sets of grid members are positioned such that the back side of the first set of grid members is proximate to and parallel to the front side of the second set of grid members. The compartments shaped by the first set of grid members are symmetric to the compartments shaped by the second set of grid members, creating a three-dimensional compartment for receipt of at least one inflated balloon.

The rigid frame may be metal, plastic, wood or other suitable material. In the preferred embodiment, the rigid frame contains openings for attaching other inanimate objects to applicants' display apparatus, which may include additional apparatus of applicants' invention or other decorative devices such as frames, bridges, trellises, etc.

Once the balloons are placed in the compartments, lights may be positioned behind selected balloons to illuminate the outlines of various designs. Also, selected balloons may have a small explosive charge attached to burst selected balloons to provide a design of balloons and openings.

The technical advance represented by the invention, as well as the objects thereof, will become apparent from the following description of a preferred embodiment of the invention when considered in conjunction with the accompanying drawings and the novel features set forth in the appended claims.

BRIEF DESCRIPTION OF THE DRAWINGS

FIG. 6 is a perspective view of pivotal joining device 30.

FIG. 6*a* is a perspective view of a junction device 60.

FIG. 7 shows the formation of a grid member 114 using pivotal joining device 30 of FIG. 6.

DESCRIPTION OF A PREFERRED EMBODIMENT

Throughout this description, small alphabetical numbers are generally used to indicate multiple items of the same kind.

Figure 1:
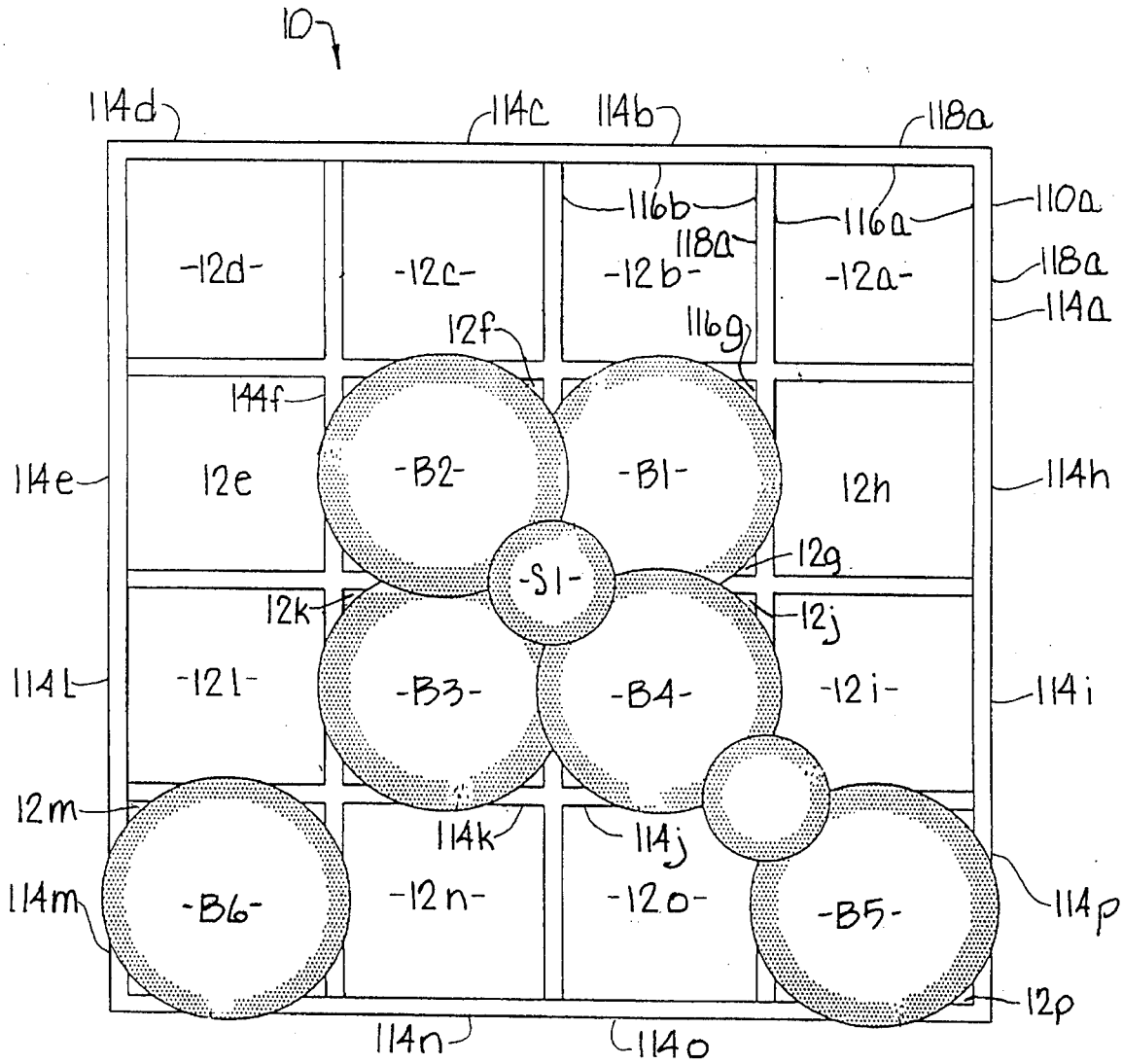
FIG. 1 illustrates a frontal view of display 10 with several balloons mounted therein.

Referring to FIG. 1, applicants' display 10 is comprised of at least one set 110*a* of grid members 114*a–p*. In other embodiments, additional or fewer grid members 114 may be used as reflected in FIGS. 4 and 9. In all embodiments, each grid member 114 is shaped to form a compartment 12 for receipt of at least one inflated balloon B. Each compartment 12 has an interior side 116 and an exterior side 118. In FIG. 1, compartment 12*a* has an exterior side 118*a* which is also a portion of interior side 116*b* and a portion of interior side 116*d*. In FIG. 1, balloon B1 is maintained in compartment 12*g* by the pneumatic pressure within balloon B1 exerted against interior side 116*g* of compartment 12*g*.

As illustrated in FIG. 1, balloons B1–B4 are inserted into adjacent compartments 12*f*, 12*j*, 12*k* and held in place by interior sides 116*f*, 116*j* and 116*k*. Balloon S1 is centrally located to balloons B1–B4. Balloon S1 may he held in place by the pneumatic pressure of the air in balloons B1–B4, or may be tied at a portion of grid members 114*f*, 114*h*, 114*j* or 114*k*.

Figure 4:
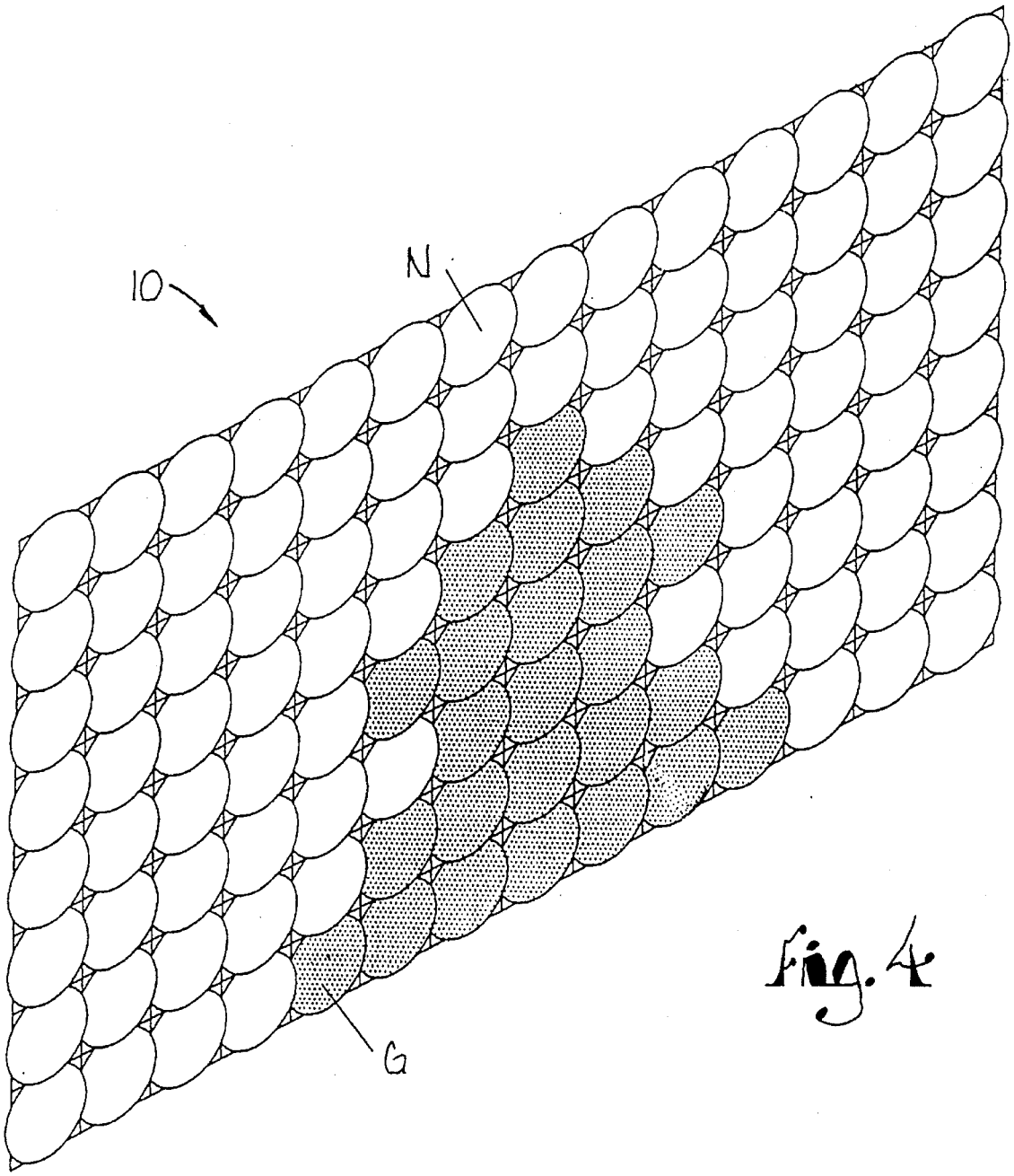
FIG. 4 is a perspective view of display 10 utilizing different color balloons to form a design.

In addition to utilizing various size balloons, various color balloons may also be used to produce a design. As shown in FIG. 4, a plurality of different color balloons are inserted in various compartments 12 to produce a Christmas tree design. Other designs of animate and inanimate objects may also be designed.

Figure 8:
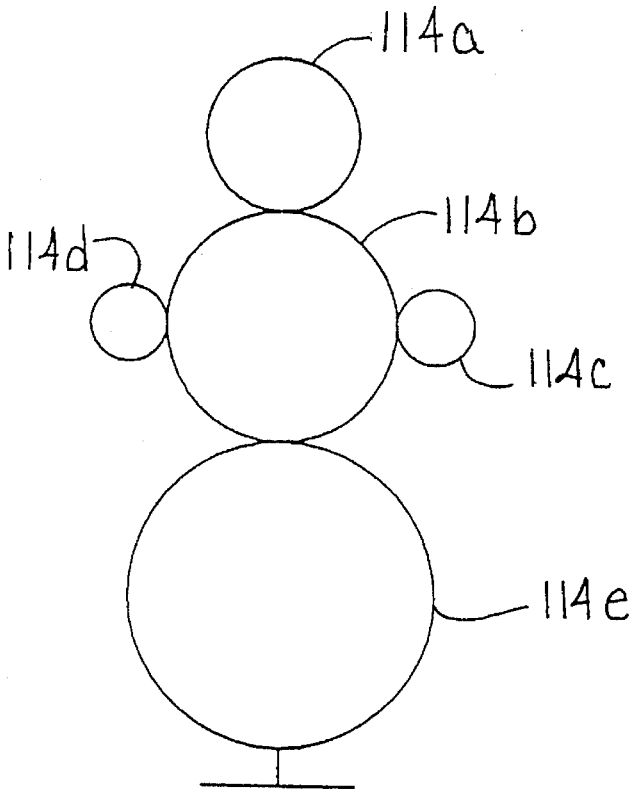
FIG. 8 is a frontal view of display 10 wherein segments 112 are circular to form a grid array in a snowman design.

Display 10 may also utilize compartments 12 of the same or different sizes. Compartments 12 may be square, rectangular, round, or any desired geometric shape dependant on the shape of grid members 114. Referring to FIG. 8, grid members 114*a–e* are circular.

Figure 9:
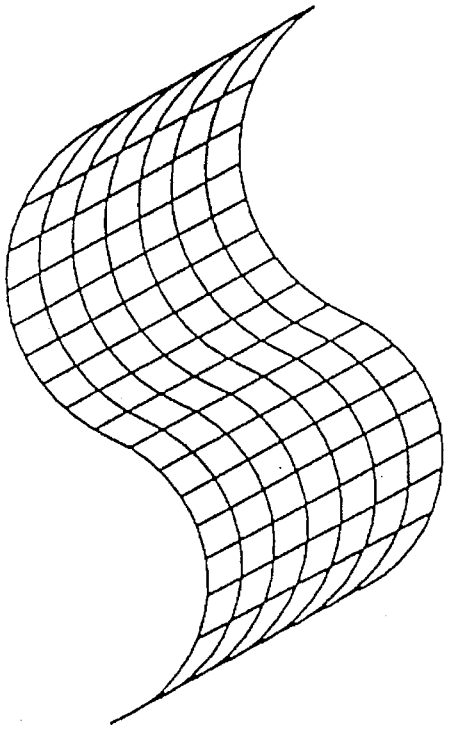
FIG. 9 illustrates the bending of display 10 to form a curved display.

Display 10 may be made of any rigid material, such as wire, plastic, or wood and also may be made of a flexible material so as to distort and bend into a desired shape as shown in FIG. 9.

Figure 2:
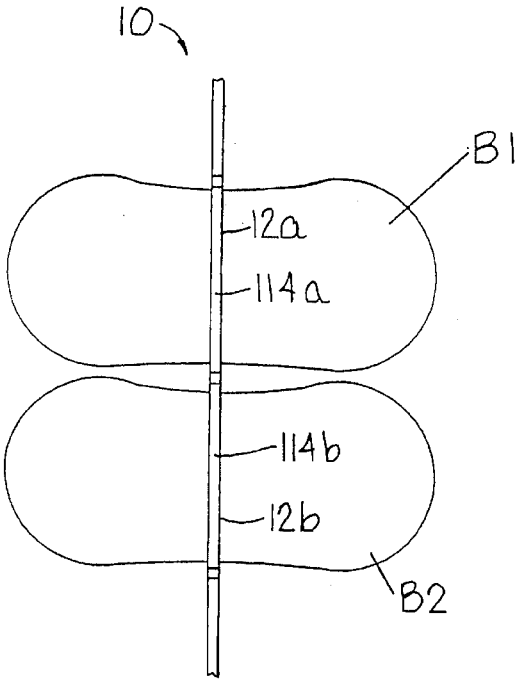
FIG. 2 is a side view of a portion of display 10 with two balloons inserted in the compartments.

FIG. 2 is a side view of a portion of display 10 showing two latex balloons B1 and B2 extending through compartments 12*a*–12*b* of grid members 114*a*, 114*b*. As shown in FIG. 2, latex balloons will distort to accommodate to the size of compartment 12. Consequently, in all embodiments, latex balloons will generally be larger on each side of compartment 12 of grid members 114 and will inflate to expand and touch adjacent balloons, concealing grid members 114.

Figure 3:
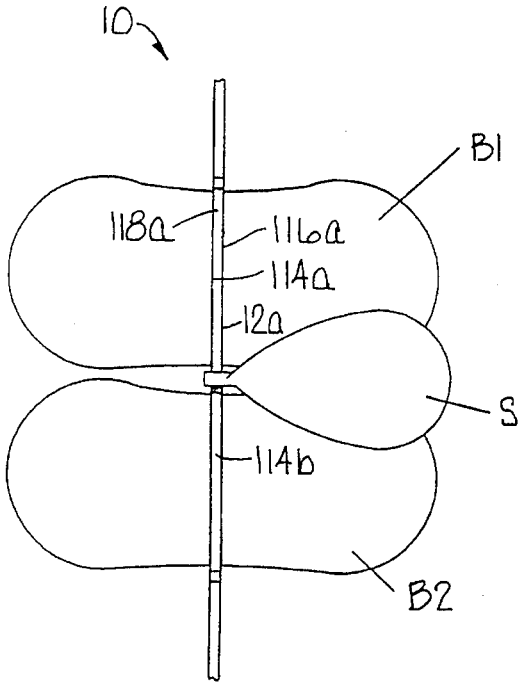
FIG. 3 is a side view of display 10 with two balloons inserted in the compartments and a third balloon between the first two balloons.

FIG. 3 is the same as FIG. 2, with the addition of balloon S inserted between balloons B1 and B2. The tied end of balloon S is secured to grid member 114*a* between balloons B1 and B2. As discussed above in reference to FIG. 1, balloon S may also be inserted in compartment 12*a* along with balloon B1, with the pneumatic pressure within balloons B1 and S and interior side 116a of compartment 12*a* holding balloons B1 and S1 in place. Although not shown, two balloons may also be tied together with the tied portion stretching across grid member 114.

In the display of FIG. 4, a plurality of, for example, green balloons G (as reflected by the shading) are inserted through selected compartments 12 to form a Christmas tree. Other non-green balloons N (nonshaded balloons) are placed in compartments 12 not occupied by green balloons. With the green and non-green balloons inserted in the correct compartments 12, a display representative of a Christmas tree is formed. Any other animate or inanimate objects may be displayed by placing balloons of different colors in proper compartments 12 to outline the desired object.

Figure 5:
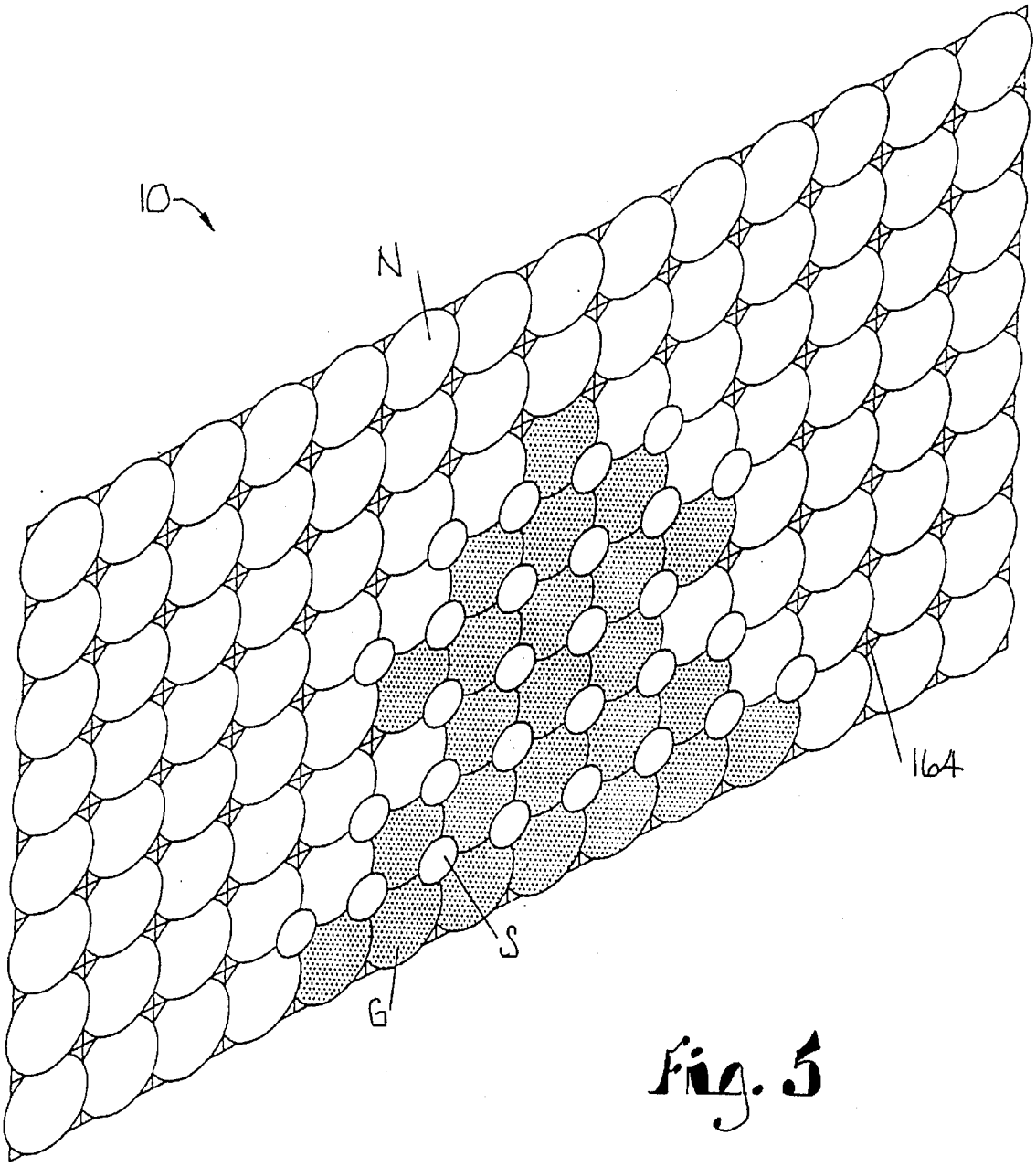
FIG. 5 is a perspective view of display 10 as in FIG. 4, with additional balloons to add more dimension to the design.

FIG. 5 illustrates the same basic design of a Christmas tree as in FIG. 4 with balloons S tied at intersections 164 of grid members 114. Balloons S may be, for example, red balloons to represent ornaments or lights on the Christmas tree. Small electric lights (not illustrated) may be placed adjacent some of balloons S to illuminate them and to give the effect of lights.

FIG. 6 illustrates a pivotal joining device 30 which may be utilized in forming display 10. Plate 31 is comprised of first face 120 and second face 122. First clip member 32 is comprised of segment receiving section 124 and pivotal attaching section 126. Pivotal attaching section 126 of first clip member 32 is pivotally attached to first face 120 of plate 31. Second clip member 33 is comprised of segment receiving section 128 and pivotal attaching section 130. Pivotal attaching section 130 of second clip member 33 is pivotally attached to second face 122 of plate 31. Clip members 32 and 33 are preferably flexible so that segments 132 of grid members 114 may be inserted and held in place by the spring action of segment receiving sections 124 and 128. As shown in FIG. 7, a plurality of pivotal joining devices 30*a–d* are used to connect a plurality of segments 132*a–d* to form a display 10 having a plurality of compartments 12 into which inflated balloons are inserted. Display 10 as shown in FIGS. 1–5 may be constructed utilizing a plurality of segments 132 and pivotal joining devices 30.

FIG. 7 illustrates a display 10 having square or rectangular compartments 12, but triangular or other geometric shaped compartments may be assembled using pivotal joining devices 30 and segments 132. For example, FIG. 8 illustrates the use of circular grid members 114 joined by pivotal joining devices 30 (not shown). In display 10 as illustrated in FIG. 8, balloons may be inserted into compartments 12 of grid members 114 to form a snowman.

FIG. 6*a* shows a junction device 60 that can be used for the side of display 10. Junction device 60 has channel 61 with an opening 63 to hold a segment 132. Extending at a right angle from channel 61 is channel 62 having an opening 64 to receive a segment 132. Junction device 60 is useful in forming the outer sides of display 10. The openings 63 and 64 in junction device 60 are to the side of a channel. Channels 61 and 62 could be tubes with rods inserted in the ends of the channel.

FIG. 9 shows a flexible display 10 that may be shaped by twisting and curving to provide a decorative display 10 into which inflated balloons are inserted. Flexible display 10 may be manufactured and sold in rolls so that sections may be cut from the roll to form a desired decorative display.

To provide three-dimensional effects, several grid frames may be attached to each other, some of which may be flat, some rolled and some twisted. Balloons are then inserted in various grid openings to produce the desired display.

Figure 10:
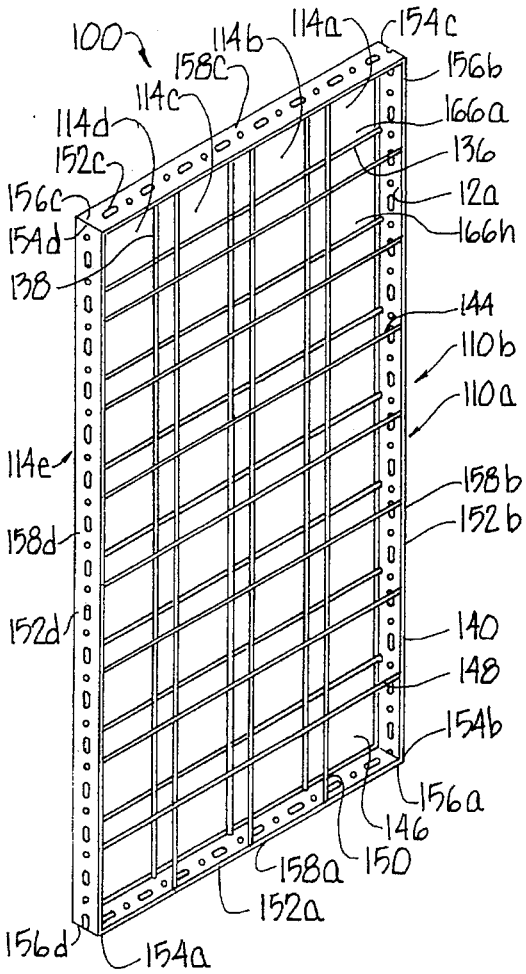
FIG. 10 is a perspective view of applicants' alternative embodiment, display 100.

FIG. 10 illustrates an alternative embodiment 100 of applicants' invention. Display 100 is comprised of a second set 110*b* of grid members 166. Second set 110*b* of grid members 166 have a front side 136 and a back side 138. Grid members 166 are each shaped to form compartments 14.

Display 100 is further comprised of a rigid frame 140. First set 110*a* of grid members 114 and second set 110*b* of grid members 166 are rigidly attached to rigid frame 140 such that back side 144 of first set 110*a* of grid members 114 is proximate to and parallel to front side 136 of second set 110*b* of grid members 166. Compartments 12, shaped by first set 110*a* of grid members 114, are symmetric to compartments 14, shaped by second set 110*b* of grid members 166, creating three-dimensional compartments 146 for receipt of at least one inflated balloon. Like display 10, display 100 can also utilize three-dimensional compartments 146 of the same or different sizes. Three dimensional compartments 146 may be square, rectangular, round or any desired geometric shape dependent on the shape of grid members 114 and 166 and the distance between first set 110*a* and second set 110*b*, the preferred shape being about 6" by about 6" by about 1½" squares.

Rigid frame 140 is comprised of at least three arm members 152 rigidly joined in a generally triangular shape, and in the preferred embodiment four arm members 152 rigidly join in a generally rectangular shape. A square shape is considered to be included within a rectangular shape. Arm members 152 each have first end 154, second end 156 and midsection 158.

In FIGS. 10–13, first set 110*a* of grid members 114 are comprised of first set of rod-shaped segments 148 and second set of rod-shaped segments 150. As shown in FIG. 10, first set of rod-shaped segments 148 and second set of rod-shaped segments 150 are rigidly attached to midsections 158*a–d* of arms 152*a–d* such that first set of rod-shaped segments 148 are perpendicular to second set of rod-shaped segments 150 creating a majority of rectangular shaped compartments 12. Second set 110*b* of grid members 166 are similarly comprised and attached to rigid frame 140.

Rod-shaped segments 148 and 150, as well as the rod-shaped segments of second set 110*b* of grid members 166, are comprised of substantially rigid material such as plastic coated or painted wire, wooden slats, plastic or other materials which are substantially rigid, the preferred being painted wire. The rod-shaped segments are attached by welding, nails or other attaching means complimentary to the material used in making the rod-shaped segments.

Figure 12:
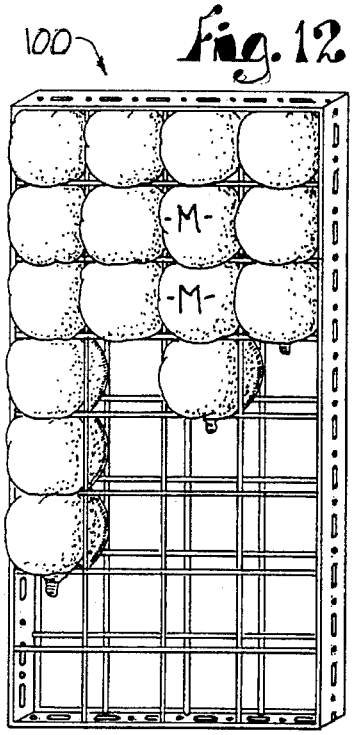
FIG. 12 is a front perspective view of applicants' alternative embodiment, display 100, in use with Microfoil aluminized film balloons (MICROFOIL is a registered trademark of Continental American Corporation d/b/a Pioneer Balloon Company).
Figure 13:
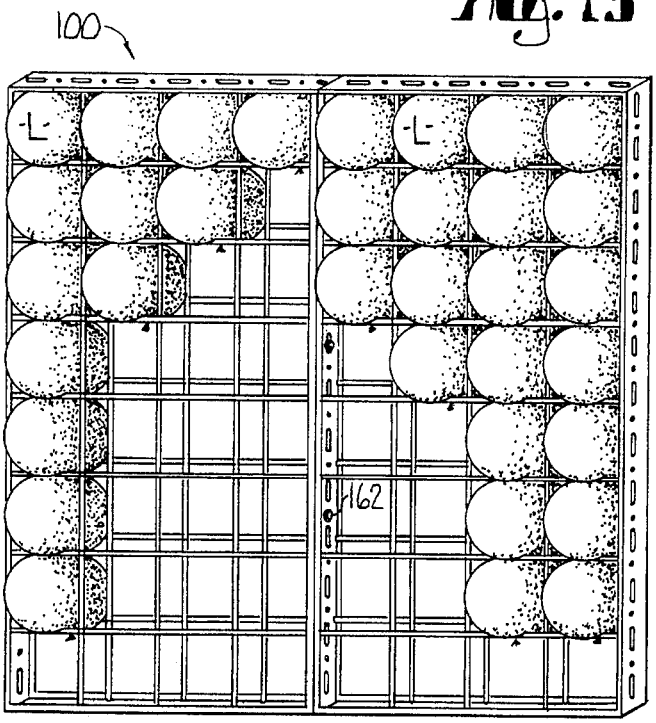
FIG. 13 is a front perspective view of applicants' alternative embodiment, display 100, in use with latex balloons and attached to a second display 100.

As shown in FIG. 12 and FIG. 13, display 100 may be used with either latex L or Microfoil M balloons or a combination of both (not shown).

Figure 11:
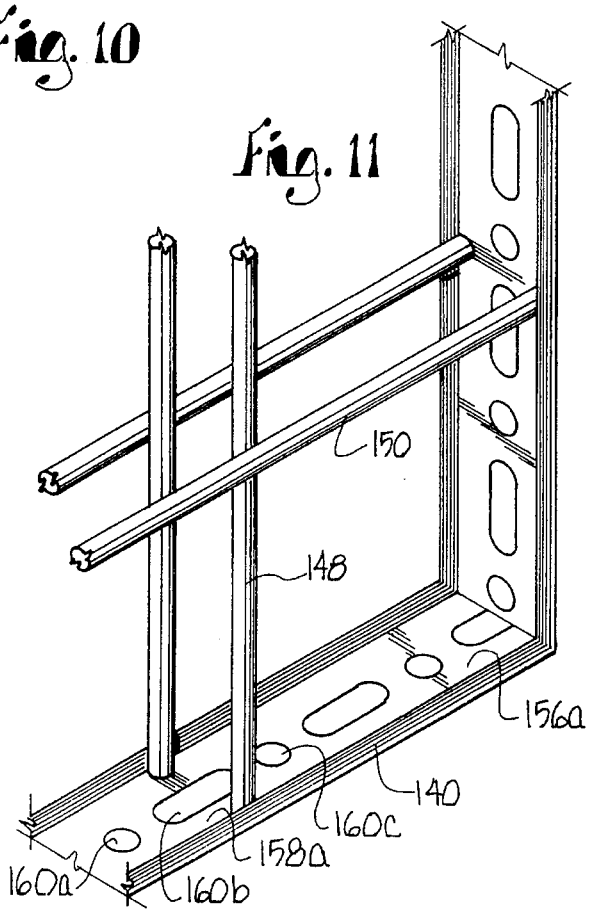
FIG. 11 is an expanded view of a corner of display 100.

As illustrated in FIG. 11, midsection 158 of rigid frame 140 contains openings 160 for receiving fastening means 162 (see FIG. 13) for securing a second display 100 or other inanimate objects to display 100 as shown in FIG. 13. Openings 160 may be of various shapes and sizes for ease of fastening. Fastening means 162 may be bolts, screws, clips or other materials which secure display 100 to an inanimate object.

FIGS. 12 and 13 illustrate a free-standing embodiment of display 100. Display 100 may be supported by feet fixidly attached to arms 152 of rigid frame 140. The feet may be t-shaped or any other suitably designed shape that will add stability to display 100.

To use display 100, a balloon is inflated and tied. In one method, the tied portion is then inserted between set 110*a* of grid members 114 and second set 110*b* of grid members 166 into three-dimensional compartment 146. The tied off portion of the balloon is pulled through the bottom edge of three-dimensional compartment 146 such that balloon B is held by three-dimensional compartment 146. If Microfoil balloons are used, a similar procedure is used wherein the tab of the mylar balloon is pulled through three-dimensional compartment 146 as discussed above. In another method, balloon B is simply pushed into three-dimensional compartments 146 and the tied portion is then tucked into three-dimensional compartments 146 such that it is hidden from view.

What is claimed and desired to be secured by Letters Patent is as follows:

1. A balloon display apparatus in combination with balloons, comprising:

a. a grid array comprised of at least one set of grid members, said set of grid members having a front side and a back side;

b. said grid members each shaped to form a compartment having depth for receipt of at least one inflated balloon, said balloon being deformably squeezed into said compartment;

c. said compartments having an interior side and an exterior side, said inflated balloon being maintained deformed and squeezed in said compartment by the pneumatic pressure within said inflated balloon exerted against said interior side of said compartment to create a balloon display; and d. adjacent grid members meeting at an intersection.

2. The apparatus of claim 1 wherein said set of grid members are formed by a plurality of segments.

3. The apparatus of claim 2 wherein said segments are rod shaped.

4. The apparatus of claim 3 wherein said rod-shaped segments are divided into two sets;

a. said segments in said first set of segments positioned about an equal distance apart;

b. said segments in said second set of segments positioned about an equal distance apart;

c. said first set of segments positioned generally perpendicular to said second set of segments.

5. The apparatus of claim 2 wherein said segments are circular shaped.

6. The apparatus of claim 2 wherein said segments are connected by pivotal joining devices, said pivotal joining devices comprised of:

a. a plate with a first face and a second face;

b. a first clip member with a segment receiving section and a pivotal attaching section;

i. said pivotal attaching section of said first clip member pivotally attached to said first face of said plate; and c. a second clip member with a segment receiving section and a pivotal attaching section;

i. said pivotal attaching section of said second clip member pivotally attached to said second face of said plate.

7. The apparatus of claim 1 further comprising:

a. a second set of grid members having a front side and a back side, said grid members each shaped to form a compartment, said adjacent grid members meeting at an intersection; and b. a rigid frame attached to said first and second sets of grid members such that said back side of said first set of grid members is proximate to and parallel to said front side of said second set of grid members, and said compartments shaped by said first set of grid members are symmetric to said compartments shaped by said second set of grid members creating a three-dimensional compartment for receipt of at least one inflated balloon.

8. The apparatus of claim 7 wherein said compartments are commensurably sized to said inflated balloons.

9. The apparatus of claim 7 wherein a. said first set and said second sets of grid members are each comprised of: i. a first set of rod-shaped segments; and ii. a second set of rod-shaped segments;

b. said rigid frame comprised of: i. at least three arm members rigidly joined, said arm members having a first and second end and a mid-section; and c. said first and second sets of rod-shaped segments attached to said mid-sections of said arm members such that said first set of rod-shaped segments are generally perpendicular to said second set of rod-shaped segments creating a majority of said three-dimensional compartments.

10. The apparatus of claim 9 wherein said midsection of said arm members contains openings for receiving a fastening member for securing an inanimate object to said apparatus.

11. The apparatus of claim 7 wherein a. said first set and said second set of grid members are each comprised of:

i. a first set of rod-shaped segments; and ii. a second set of rod-shaped segments b. said rigid frame comprised of:

i. at least four arm members rigidly joined in a geometrical shape, said arm members having a first and second end and a mid-section; and c. said first and second sets of rod-shaped segments attached to said mid-sections of said arm members such that said first set of rod-shaped segments are generally perpendicular to said second set of rod-shaped segments creating a majority of said three-dimensional compartments.

12. The apparatus of claim 11 wherein said midsection of said arm members contains openings for receiving a fastening member for securing an inanimate object to said apparatus.

13. A balloon display apparatus in combination with balloons, comprising:

a. a grid array comprised of at least one set of grid members, said grid members having a front side and a back side;

b. said grid members each shaped to form a compartment having depth for receipt of at least one inflated balloon, said balloon being deformably squeezed into said compartment;

c. said compartments having an interior side and an exterior side, said inflated balloon being maintained in said compartment by the pneumatic pressure within said inflated balloon exerted against said interior side of said compartment to create said balloon display;

d. said set of grid members comprised of segments connected by pivotal joining devices; and e. said pivotal joining devices comprised of:

i. a plate with a first face and a second face;

ii. a first clip member with a segment receiving section and a pivotal attaching section;

(a) said pivotal attaching section of said first clip member pivotally attached to said first face of said plate; and iii. a second clip member with a segment receiving section and a pivotal attaching section;

(b) said pivotal attaching section of said second clip member pivotally attached to said second face of said plate.

14. A balloon display apparatus in combination with balloons, comprising:

a. a grid array comprised of at least two sets of grid members, said sets of grid members having a front side and a back side;

b. said first set of grid members each shaped to form a compartment with said adjacent grid members meeting at an intersection;

c. said second set of grid members each shaped to form a compartment with said adjacent grid members meeting at an intersection;

d. said compartments having an interior side and an exterior side;

e. a rigid frame attached to said first and said second sets of grid members such that said back side of said first set of grid members is proximate to and parallel to said front side of said second set of grid members, and said compartments shaped by said first set of grid members are symmetric to said compartments shaped by said second set of grid members creating a three-dimensional compartment for receipt of at least one inflated balloon; and f. said inflated balloon being maintained in said three-dimensional compartment by the pneumatic pressure within said inflated balloon exerted against said interior sides of said compartments to create said balloon display.

15. The apparatus of claim 14 wherein a. said first set and said second set of grid members are comprised of:

i. a first set of rod-shaped segments; and ii. a second set of rod-shaped segments;

b. said rigid frame comprised of:

i. at least four arm members rigidly joined in a geometrical shape, said arm members having a first and second end and a mid-section; and c. said first and second sets of rod-shaped segments attached to said mid-sections of said arm members such that said first set of rod-shaped segments are generally perpendicular to said second set of rod-shaped segments creating a majority of said three-dimensional compartments.

16. The apparatus of claim 15 wherein said midsection of said arm members contains openings for receiving a fastening member for securing an inanimate object to said apparatus.

17. The apparatus of claim 16 further comprising at least one foot member attached to said apparatus to add stability to said apparatus.

18. A balloon display apparatus in combination with balloons, comprising:

a. a grid array comprised of at least one set of grid members, said set of grid members having a front side and a back side;

b. said grid members each shaped to form a compartment having depth for receipt of at least one inflated balloon said balloon, being deformably squeezed into said compartment;

c. each said compartment having an interior side and an exterior side, said inflated balloon being maintained in said compartment by the pneumatic pressure within said inflated balloon exerted against said interior side of said compartment to create a balloon display;

d. adjacent grid members meeting at an intersection; and e. a rigid frame attached to said set of grid members.

* * * * *